US006991587B1

(12) United States Patent
Eschenbach

(10) Patent No.: US 6,991,587 B1
(45) Date of Patent: Jan. 31, 2006

(54) ELLIPTICAL EXERCISE APPARATUS WITH ADJUSTMENT

(76) Inventor: Paul William Eschenbach, 290 S. Tyger La., Roebuck, SC (US) 29376

( * ) Notice: Subject to any disclaimer, the term of this patent is extended or adjusted under 35 U.S.C. 154(b) by 0 days.

(21) Appl. No.: 10/938,140

(22) Filed: Sep. 10, 2004

(51) Int. Cl.
*A63B 69/16* (2006.01)

(52) U.S. Cl. ..... 482/52; 482/57

(58) Field of Classification Search ..... 482/51–53, 482/57, 70, 79–80
See application file for complete search history.

(56) References Cited

U.S. PATENT DOCUMENTS

| | | | | |
|---|---|---|---|---|
| D330,236 | S | 10/1992 | Jarriel et al. | D21/194 |
| 5,279,529 | A | 1/1994 | Eschenbach | 482/57 |
| 5,387,167 | A | 2/1995 | Johnson | 482/57 |
| 5,403,255 | A | 4/1995 | Johnson | 482/57 |
| 5,529,555 | A | 6/1996 | Rodgers | 482/57 |
| 5,647,821 | A | 7/1997 | Johnson | 482/57 |
| 5,792,028 | A | 8/1998 | Jarvie | 482/51 |
| 5,902,216 | A | 5/1999 | Lee | 482/57 |
| 5,944,636 | A | 8/1999 | Johnson | 482/57 |
| 5,957,814 | A | 9/1999 | Eschenbach | 482/51 |
| 6,024,676 | A | 2/2000 | Eschenbach | 482/51 |
| 6,042,512 | A | 3/2000 | Eschenbach | 482/52 |
| 6,045,487 | A * | 4/2000 | Miller | 482/52 |
| 6,120,417 | A | 9/2000 | Johnson | 482/57 |
| 6,146,314 | A | 11/2000 | Lee | 482/57 |
| 6,217,486 | B1 | 4/2001 | Rosenow | 482/52 |
| 6,238,321 | B1 | 5/2001 | Arnold et al. | 482/52 |
| 6,251,050 | B1 | 6/2001 | Johnson | 482/57 |
| 6,361,476 | B1 | 3/2002 | Eschenbach | 482/52 |
| 6,746,377 | B2 | 6/2004 | Johnson | 482/57 |
| 6,755,769 | B2 | 6/2004 | Johnson | 482/57 |

* cited by examiner

*Primary Examiner*—Stephen R. Crow

(57) ABSTRACT

The present invention relates to a standup exercise apparatus that simulates walking, jogging and climbing with arm exercise. More particularly, the present invention relates to an exercise machine having separately supported pedals for the feet and arm exercise coordinated with the motion of the feet. Elliptical cross trainers guide the feet along a generally elliptical shaped curve to simulate the motions of jogging and climbing. Existing elliptical cross trainers often use excessive pedal articulation which can overwork the ankle to achieve a longer stride. The present invention is an improved elliptical exercise machine capable of extended exercise with less pedal articulation that is more ankle friendly. One end of a foot support member is guided by a guide for back and forth movement while the other end is guided by an orbital link to drive an alternator and flywheel. The resulting pedal motion is foot friendly. Stride length can be adjusted. Handles are coordinated with the foot support members for arm exercise.

20 Claims, 4 Drawing Sheets

ELLIPTICAL EXERCISE APPARATUS WITH ADJUSTMENT

BACKGROUND OF THE INVENTION

1. Field

The present invention relates to a standup exercise apparatus that simulates walking, jogging and climbing with arm exercise. More particularly, the present invention relates to an exercise machine having separately supported pedals for the feet and arm exercise coordinated with the motion of the feet.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they use long cranks to generate a long foot stride having excessive pedal articulation. There is a need for an elliptical exercise machine capable of a similar long stride using a linkage to modify a shorter crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

Eschenbach in U.S. Pat. No. 5,957,814 shows the use of an orbital link in a front drive elliptical design. Several rear drive elliptical cross trainers are shown by Eschenbach in U.S. Pat. Nos. 6,042,512 and 6,361,476. Rosenow in U.S. Pat. No. 6,217,486 and Arnold et al. in U.S. Pat. No. 6,238,321 show typical commercial rear drive elliptical cross trainers in use today.

Jarriel et al. in U.S. Des. Pat. No. 330,236 shows a pair of equal length cranks that guide a pedal for standup exercise. Eschenbach in U.S. Pat. No. 5,279,529 shows a double crank configuration to guide a pedal where each crank is a different length. Johnson in U.S. Pat. Nos. 5,387,167, 5,403,255, 5,647,821, 5,944,636, 6,120,417, 6,251,050, 6,746,377 and 6,755,769 displays pedals guided by two cranks of the same length and having different lengths.

Lee in U.S. Pat. Nos. 5,902,216 and 6,146,314 shows a pair of unequal length cranks to guide a pedal with arm exercise added. Jarvie in U.S. Pat. No. 5,792,028 also shows a pair of cranks with a linkage for striding. Rodgers in U.S. Pat. No. 5,529,555 shows a linkage with two cranks to generate an ellipse.

There is a need for a pedal operated exercise machine that can be safely operated in the standup position whereby the arms and legs can be exercised with the feet moving through a generally elliptical movement without excessive pedal articulation. There is also a need to adjust the stride length while maintaining less pedal articulation.

It is one objective of this invention to provide an elliptical pedal movement with a path generating linkage that provides a long stride with less pedal articulation. Excessive pedal articulation causes ankle stress. Another object of this invention is to provide an adjustable stride.

SUMMARY OF THE INVENTION

The present invention relates to the kinematic motion control of pedals which simulate running, climbing and cycling during several modes of operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles vary during the pedal cycle to maintain the heel of the foot generally in contact with the pedal with less pedal articulation. As the foot is raised, the heel of the foot remains generally in contact with the inclining pedal for safer operation. Arm exercise is by arm levers coordinated with the mechanism guiding the foot pedals.

In the preferred embodiment, the apparatus includes a separate pedal for each foot, each pedal being extended by a foot support member and partially supported by an orbital oblong guide path at the first portion of the foot support member. The oblong guide path generating linkage has a first crank arm which completes one full revolution during a pedal cycle and is phased generally opposite the first crank arm for the other pedal through a crankshaft pivot axis attached to the framework.

An orbital link is connected to the first crank arm pivot configured so that all portions of the orbital link traverse orbital paths as the first crank arm rotates. This is accomplished by the addition of a connector link pivotally connected to the orbital link and to a second crank arm which rotates at the same speed as the first crank arm. The second crank arms can have a variable length which can cause the stride length to change.

A second portion of the foot support member is supported with a pivot by a guide link which is pivotally connected to the framework. As the crank arms are driven by foot motion, the pedals follows an elongate curve approximating an ellipse having less pedal articulation than other elliptical cross trainers having long crank arms. Alternately, the guide links can be replaced with guides in contact with rollers positioned on the foot support member.

Arm exercise is provided with handles pivotally connected to the framework and coordinated with the guide links. When the foot is forward, the handle corresponding to that foot is generally rearward.

Load resistance is imposed upon the crank arms through pulleys and belts from a flywheel and alternator. A control system regulates the load on the alternator to vary the resistance to exercise. The resistance can be varied during operation through a control system within easy reach of the operator. Other forms of load resistance such as friction, magnetic, air, belt, etc. may also be used.

Movement of the pedals cause the first portion of the foot support member to follow an elongate orbital path similar to an ellipse where the longer major axis of the ellipse is generally horizontal to provide the longer stride length. The shorter minor axis of the ellipse results in less pedal articulation.

In summary, this invention provides the operator with stable foot pedal support having motions that simulate running, climbing and cycling with very low joint impact and upper body exercise. The pedal motion exhibits a long stride with less pedal articulation common to other elliptical trainers for less ankle stress regardless of stride length.

DETAILED DESCRIPTION OF THE EMBODIMENTS

Figure 1:
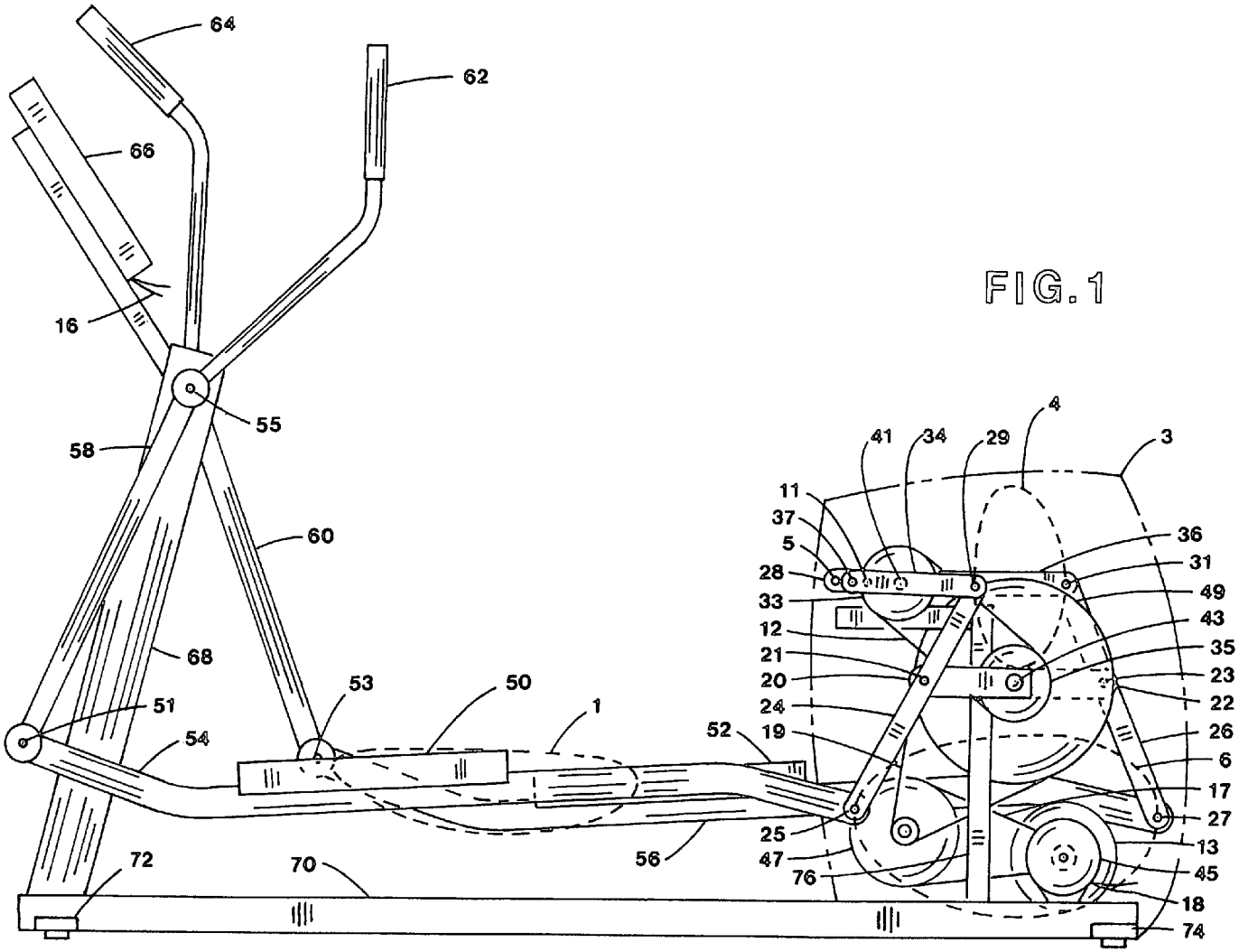
FIG. 1 is a right side elevation view of the preferred embodiment of an exercise machine constructed in accordance with the present invention.
Figure 2:
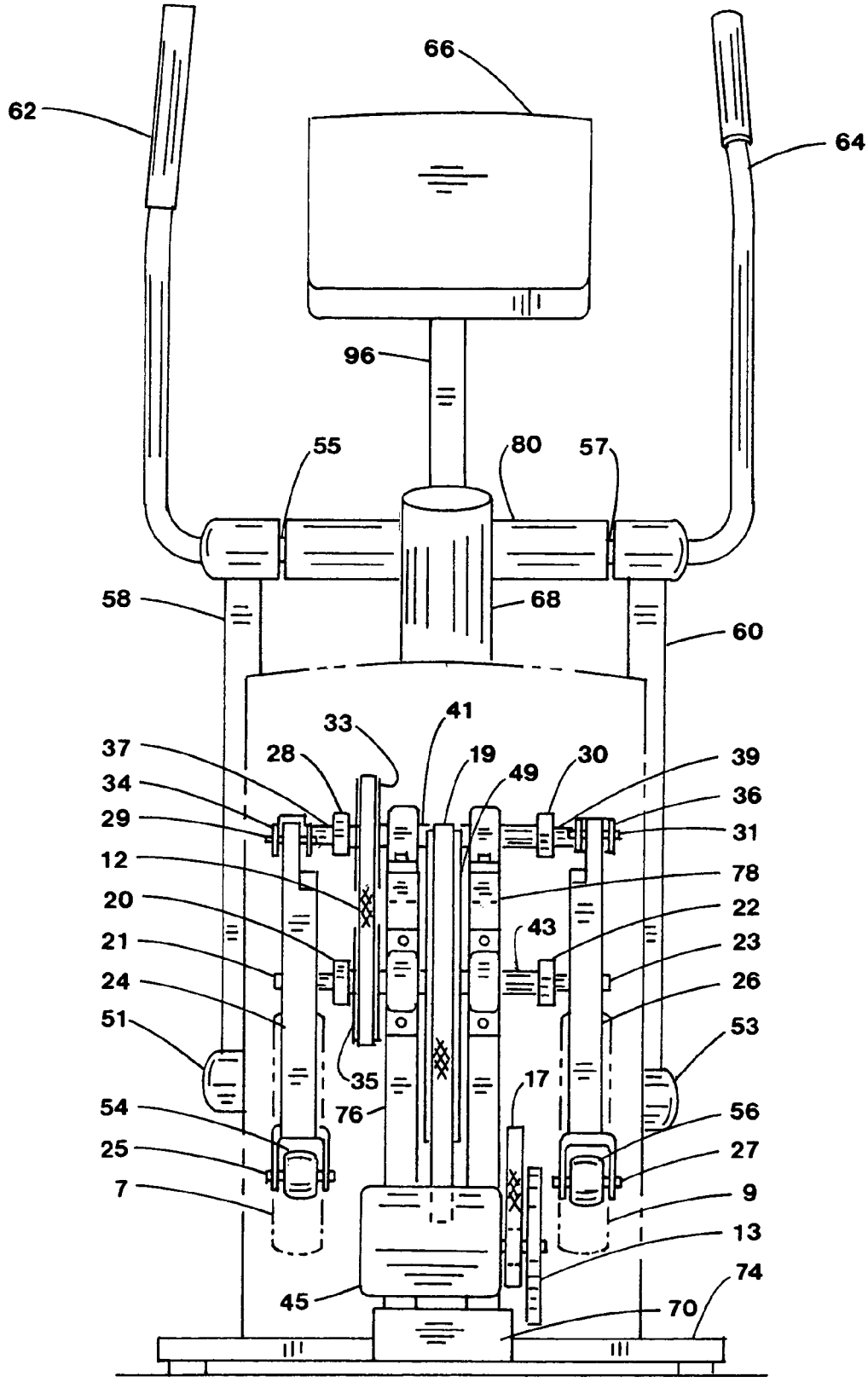
FIG. 2 is the rear view of the preferred embodiment shown in FIG. 1.

Referring to the drawings in detail, pedals 50 and 52 are shown in FIGS. 1 and 2 in the most forward and rearward positions of the first embodiment. Pedals 50 and 52 are supported by foot support members 54 and 56 and traverse an elongate closed loop path 1. Foot support members 54,56 are connected to guide links 58,60 at pivots 51,53 and connected to orbital links 24,26 at pivots 25,27. Guide links 58,60 are connected to frame member 80 at pivots 55,57.

Orbital links 24,26 are connected to crank arms 20,22 and connector links 34,36 at pivots 29,31. Crank arms 20,22 are joined as generally opposed at pivot axis 43 to form a first crank. A second crank having crank arms 28,30 rotates about second pivot axis 41. Connector links 34,36 are connected to second crank arms 28,30 at pivots 37,39. Pulley 35 rotates with first crank arm 20 and pulley 33 rotates with second crank arm 28. Belt 12 engages pulleys 33 and 35 to cause first crank arm 20 and second crank arm 28 to rotate at the same speed. Alternative pivot locations 5,11 on second cranks 28,30 provide for a variable length crank.

Each portion of orbital links 24,26 follow orbiting paths such as orbital path 6 traversed by pivots 25,27 and orbital path 4 traversed by pivots 29,31. Orbital links 24,26, first crank arms 20,22, second crank arms 28,30, and connector links 34,36 form a pair of path generating linkages configured to guide the first portion of the foot support member 54,56 along orbital path 6. For this embodiment, note that path 6 followed by the end of foot support members 54,56 does not orbit first pivot axis 43 or second pivot axis 41.

Handles 62,64 are attached to guide links 58,60 for arm exercise. Pulley 49 is attached to crank arms 20,22 and rotates about pivot axis 43 to drive alternator 45 and flywheel 13 through belts 17,19 and step-up pulley 47. Alternator 45 is supported by frame 70 and is connected to controller 66 by wires 16,18 using conventional wiring (not shown). Controller 66 is attached to frame member 68 by support 96 and works with alternator 45 to provide variable resistance to exercise using conventional methods. A shroud 3 is shown with slots 7,9 to enclose the drive system to allow foot support members 54,56 to protrude.

Horizontal member 80 supports guide pivots 55,57 and is attached to frame member 70 by upright support 68. First crank pivot axis 43 and second crank pivot axis 41 are supported by upright members 76,78 which are attached to frame member 70. Cross members 72,74 are supported by the floor and attach to frame member 70. Pulley 47 is supported by a pulley support (not shown) attached to frame member 70.

Figure 3:
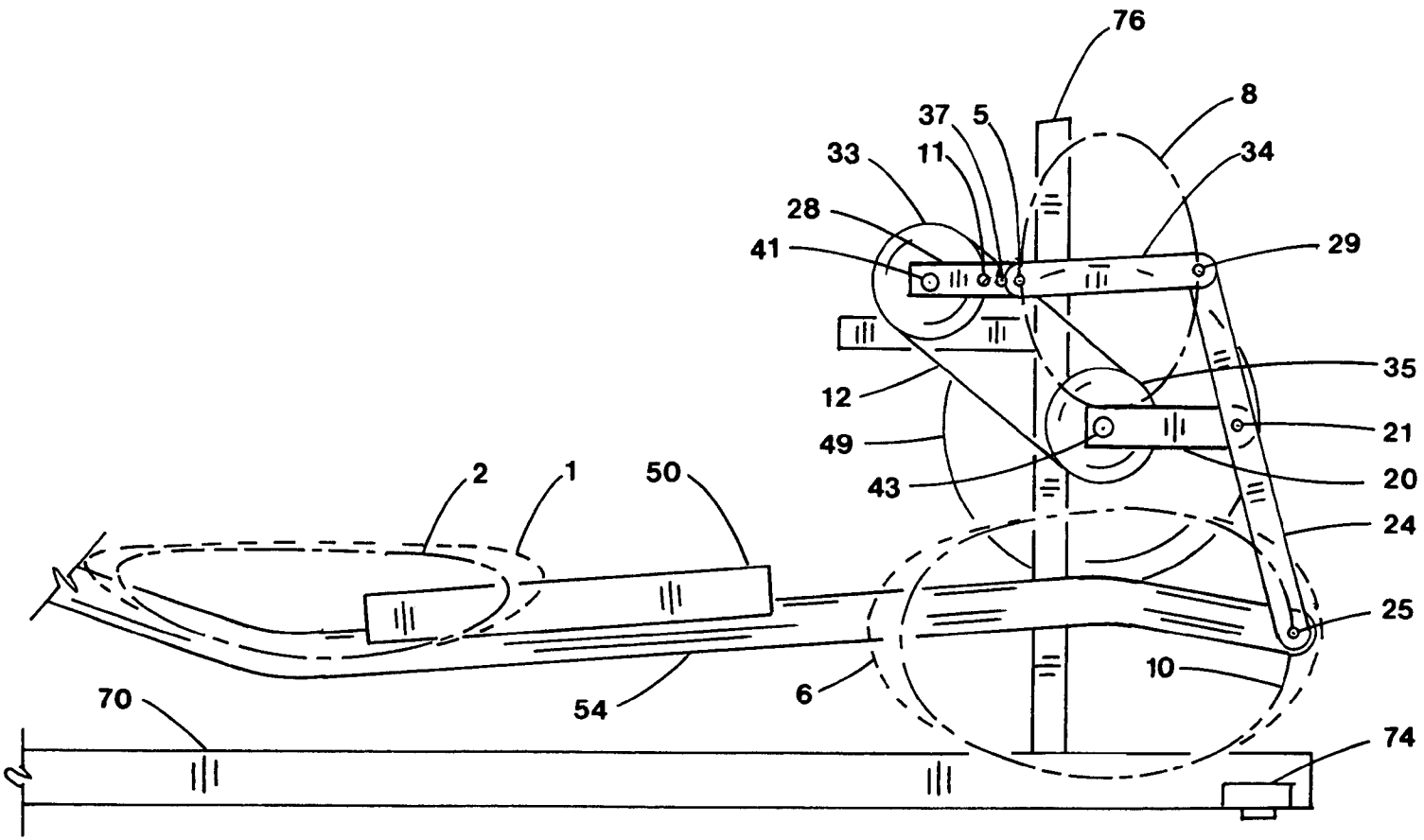
FIG. 3 is is a side elevation view of the preferred embodiment shown in FIG. 1 after a crank length adjustment.

The preferred embodiment is shown in FIG. 3 where the second crank arms 28,30 have been lengthened with connector links 34,36 connected at pivot 5. Orbital link 24 now has pivot 29 following elliptical curve 8 and pivot 25 follows elliptical curve 10. Elliptical curve 10 is shorter in length than curve 6 resulting in a shorter stride curve 2 versus pedal curve 1 shown in FIG. 1. The forward end of the preferred embodiment, companion foot support member 56 and the companion path generating mechanism are not shown for clarity.

Figure 4:
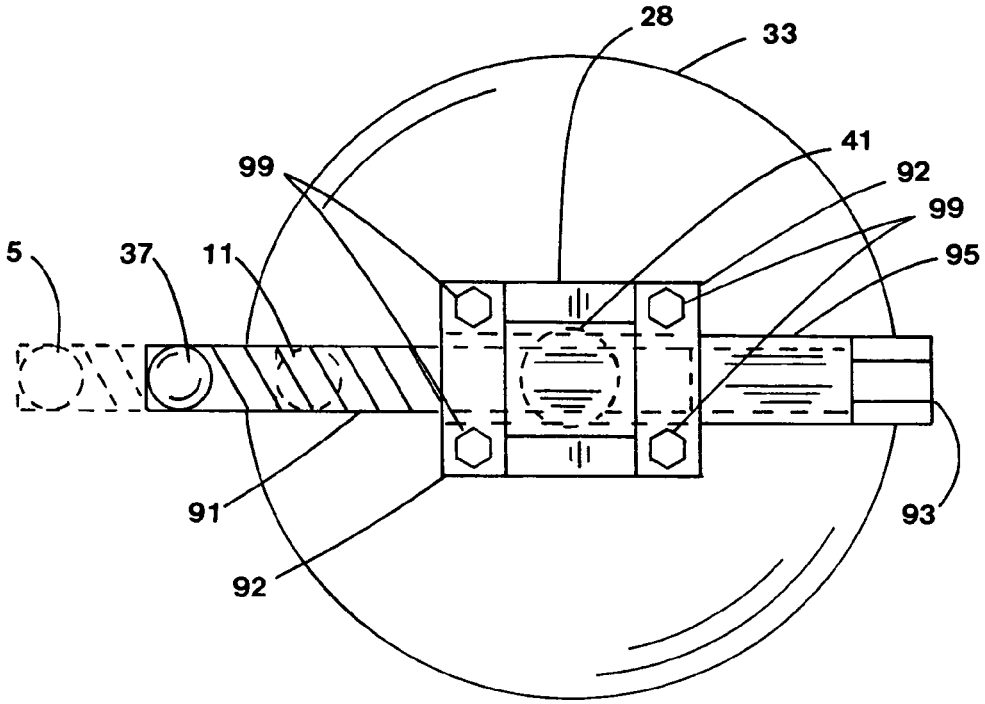
FIG. 4 is a side view of the preferred embodiment shown in FIG. 1 with an adjustable crank.

FIG. 4 shows a crank arm assembly as a typical means to adjust the length of second crank arms 28,30. Threaded member 91 has pivot 37 on one end and is engaged with internally threaded member 95. Internally threaded member 95 is allowed to rotate in covers 92 which is attached to second crank arm 28 by bolts 99. The crank arm assembly rotates about second pivot axis 41. Internally threaded member 95 has a hex end 93 to allow rotation for adjustment by a tool such as a socket (not shown). Turning of internally threaded member 95 will cause threaded member 91 to extend to pivot position 5 or by turning in reverse to contract to pivot position 11.

Alternately, a stepping motor (not shown) can engage hex end 93 to adjust threaded member 91 automatically by control 66 when second crank arms 28,30 are stopped in the proper position. After adjustment, the stepping motor would retract out of the way.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise apparatus comprising:

a framework, said framework configured to be supported by the floor;

a pair of foot support members, each having a first portion, a second portion and a foot engaging pedal;

a first crank, said first crank rotatably attached to said framework projecting outwardly therefrom on both sides thereof;

a pair of orbital links, each said orbital link pivotally connected to said first crank and to said first portion of a respective said foot support member;

a second crank, said second crank rotatably attached to said framework projecting outwardly therefrom on both sides thereof;

a pair of connector links, each said connector link pivotally connected to said second crank and to a respective said orbital link;

a pair of guides, each said guide operably associated with a respective said foot support member and said framework to cause said second portion of said foot support member to have a back and forth movement;

said pedal configured to move relative to said framework when the foot of the user is rotating said first crank whereby said pedal follows an oblong curve path.

2. The exercise apparatus according to claim 1 wherein said second crank is positioned above said first crank.

3. The exercise apparatus according to claim 1 further comprising arm exercise, said arm exercise operably associated with said foot support members.

4. The exercise apparatus according to claim 3 wherein said arm exercise comprises a pair of handles, each said handle operably associated with a corresponding said foot support member.

5. The exercise apparatus according to claim 1 further comprising a flywheel, said flywheel rotatably connected to said framework and operably associated with said first crank.

6. The exercise apparatus according to claim 5 further comprising a load resistance, said load resistance operably associated with said flywheel, a means for adjustment of said load resistance and, a control system, said control system positioned within reach of the operator whereby said load resistance can be varied during operation of said exercise machine.

7. The exercise apparatus according to claim 1 wherein said foot support member is configured with said pedal positioned intermediate said first portion and said second portion of said foot support member.

8. The exercise apparatus according to claim 1 wherein said second crank has a length adjustment, said length adjustment configured to change the length of said oblong curve path.

9. The exercise apparatus according to claim 8 wherein said length adjustment is a threaded member, said threaded member configured to change the length of said second crank when said threaded member is turned.

10. The exercise apparatus according to claim 1 further comprising a shroud, said shroud encompassing said cranks, said orbital links and said first portion of said foot support members whereby said first portion of said foot support members protrude from said shroud.

11. An exercise apparatus comprising:

a framework, said framework configured to be supported by the floor;

a pair of foot support members, each having a first portion, a second portion and a foot engaging pedal;

a pair of first crank arms, each said first crank arm rotatably attached to said framework at a common first pivot axis;

a pair of orbital links, each said orbital link pivotally connected to a respective said first crank arm and to said first portion of a respective said foot support member;

a pair of second crank arms, each said second crank arm rotatably attached to said framework at a common second pivot axis and operably associated with said first pivot axis to rotate at the same speed as said first crank arm;

a pair of connector links, each said connector link pivotally connected to a respective said second crank arm and to a respective said orbital link;

a pair of guide links, each said guide link operably associated with a respective said foot support member and said framework to cause said second portion of said foot support member to have a back and forth movement;

said pedal configured to move relative to said framework when the foot of the user is rotating said first crank whereby said first portion of said foot support member follows an orbital path to exclude encompassing said first pivot axis.

12. The exercise apparatus according to claim 11 wherein each said second crank arm has a length adjustment, said length adjustment configured to change the length of said oblong curve path.

13. The exercise apparatus according to claim 12 wherein said length adjustment is a threaded member, said threaded member configured to change the length of said second crank when said threaded member is turned.

14. The exercise apparatus according to claim 11 further comprising a load resistance, said load resistance operably associated with said crank arms, a means for adjustment of said load resistance and, a control system, said control system positioned within reach of the operator whereby said load resistance can be varied during operation of said exercise machine.

15. The exercise apparatus according to claim 11 further comprising arm exercise, said arm exercise operably associated with said foot support members.

16. An exercise apparatus comprising:

a framework, said framework configured to be supported by the floor;

a pair of foot support members, each having a first portion, a second portion and a foot engaging pedal;

a first crank, said first crank rotatably attached to said framework projecting outwardly therefrom on both sides thereof;

a pair of orbital links, each said orbital link pivotally connected to said first crank and to said first portion of a respective said foot support member;

a second crank, said second crank having a variable length and rotatably attached to said framework projecting outwardly therefrom on both sides thereof;

a means to adjust the length of said second crank;

a pair of connector links, each said connector link pivotally connected to said second crank and to a respective said orbital link;

a pair of guides, each said guide operably associated with a respective said foot support member and said framework to cause said second portion of said foot support member to have a back and forth movement;

said pedal configured to move relative to said framework when the foot of the user is rotating said first crank whereby said pedal follows an oblong curve path that can be changed with adjustment of said second crank variable length.

17. The exercise apparatus according to claim 16 further comprising a pair of handles for arm exercise, each said handle pivotally connected to said framework and operably associated with a respective said foot support member.

18. The exercise apparatus according to claim 16 wherein said length adjustment is a threaded member, said threaded member configured to change the length of said second crank when said threaded member is turned.

19. The exercise apparatus according to claim 16 further comprising a load resistance, said load resistance operably associated with said first crank, a means for adjustment of said load resistance and, a control system, said control system positioned within reach of the operator whereby said load resistance can be varied during operation of said exercise machine.

20. The exercise apparatus according to claim 19 further comprising adjustment control of said means to adjust the length of said second crank operational with said control system.

* * * * *